US011058147B1

(12) United States Patent
Hurley

(10) Patent No.: US 11,058,147 B1
(45) Date of Patent: Jul. 13, 2021

(54) FREEZABLE SMOKING PIPE WITH INTEGRATED REFLECTIVE PARTICLES

(71) Applicant: Christopher L. Hurley, Medford, OR (US)

(72) Inventor: Christopher L. Hurley, Medford, OR (US)

( * ) Notice: Subject to any disclaimer, the term of this patent is extended or adjusted under 35 U.S.C. 154(b) by 285 days.

(21) Appl. No.: 15/629,340

(22) Filed: Jun. 21, 2017

Related U.S. Application Data

(60) Provisional application No. 62/368,217, filed on Jul. 29, 2016.

(51) Int. Cl.
*A24F 1/02* (2006.01)

(52) U.S. Cl.
CPC ..... *A24F 1/02* (2013.01)

(58) Field of Classification Search
CPC ..... A24F 1/02
USPC ..... 131/194
See application file for complete search history.

(56) References Cited

U.S. PATENT DOCUMENTS 1,142,998 A 6/1915 Turner
1,640,097 A * 8/1927 Shoop ..... A24F 1/16 131/206
2,015,781 A * 10/1935 Bowles ..... A24F 1/00 131/184.1
2,263,464 A 2/1940 Lackow et al.
2,690,753 A * 10/1954 Jackson ..... A24F 1/30 131/173
2,827,903 A 2/1956 Niederman
2,952,263 A * 9/1960 Terenzi ..... A24F 1/22 131/194
3,506,018 A 4/1970 Petrino
4,121,598 A * 10/1978 Hornsby ..... A24F 1/02 131/194
4,164,950 A 8/1979 Bechtold
D254,510 S 3/1980 Shaak
(Continued)

FOREIGN PATENT DOCUMENTS

CN 102318640 * 1/2012

OTHER PUBLICATIONS

WIPO Translation of CN 102318640 (Year: 2012).*

*Primary Examiner* — Francisco W Tschen
*Assistant Examiner* — Guy F Mongelli
(74) *Attorney, Agent, or Firm* — Richard Eldredge; Eldredge Law Firm

(57) ABSTRACT

A freezable smoking pipe with integrated reflective particles for producing a cool, dry smoke that flows to the mouth, and providing an ornamental smoking experience. The pipe comprises a bowl and a mouthpiece that are in communication through a shaft. The shaft is defined by a transparent and continuous shaft outer wall and shaft inner wall that form a channel. The bowl is defined by a transparent and continuous bowl outer wall and bowl inner wall. A cooling composition consisting of isopropyl, water, and reflective particles is sealed between the walls. The cooling composition can be frozen to cool the smoke that flows through the channel of the shaft. The duration of cooling is at least partially dependent on the space between the inner and outer walls, and the concentration of isopropyl. The reflective particles are visible through the walls and reflect light to create an ornamental smoking experience.

4 Claims, 2 Drawing Sheets

(56) References Cited

U.S. PATENT DOCUMENTS 4,774,970 A * 10/1988 Bell ..... A24F 1/02 131/175
5,598,943 A * 2/1997 Markus ..... A45C 11/20 206/545
5,779,938 A * 7/1998 Naraghi ..... C23F 11/143 252/389.62
6,116,042 A * 9/2000 Purdum ..... F25D 3/06 62/371
D582,094 S 12/2008 Lee
8,348,223 B2 1/2013 Evans
9,185,936 B2 11/2015 El-Deiry
2002/0020020 A1* 2/2002 DeMarco ..... A61H 7/001 5/652
2005/0006804 A1* 1/2005 Hartman ..... B29C 44/22 264/45.9
2006/0189503 A1* 8/2006 Gambogi ..... C11D 3/50 510/421
2007/0235050 A1* 10/2007 Li ..... A24D 3/045 131/338
2008/0127668 A1* 6/2008 DeVito ..... F25D 3/08 62/371
2008/0216851 A1* 9/2008 Olegario ..... A24D 3/045 131/202
2008/0230077 A1* 9/2008 Martilik ..... A24F 1/02 131/202
2009/0032153 A1* 2/2009 Burnett ..... A45C 5/005 150/106
2011/0005533 A1 1/2011 Evans
2011/0030415 A1* 2/2011 Breyburg ..... F25D 25/00 62/441
2012/0180803 A1 7/2012 Beloni
2013/0133672 A1* 5/2013 Walsh ..... A61H 7/001 5/652
2014/0013482 A1* 1/2014 DiBernardo ..... A41D 1/04 2/102
2014/0048085 A1 2/2014 Cox
2015/0027470 A1* 1/2015 Kane ..... A41D 1/04 2/102
2015/0068540 A1 3/2015 Hoch et al.
2015/0144145 A1* 5/2015 Chang ..... A61M 1/06
2015/0257446 A1* 9/2015 Chung ..... A45C 11/20 206/545
2015/0296878 A1* 10/2015 Mucalo ..... F25D 3/06 62/371
2015/0342250 A1 12/2015 Hoch et al.
2015/0352320 A1* 12/2015 Eddy ..... A24F 1/22 131/194
2016/0044960 A1 2/2016 O'Connor
2016/0206794 A1* 7/2016 Makower ..... A61M 1/06

* cited by examiner

FREEZABLE SMOKING PIPE WITH INTEGRATED REFLECTIVE PARTICLES

CROSS-REFERENCE TO RELATED APPLICATIONS

This application claims priority from U.S. Provisional Application Ser. No. 62/368,217, entitled "Freezable Smoking Pipe with Integrated Reflective Particles", filed on Jul. 29, 2016, which application is hereby incorporated herein by reference in its entirety.

FIELD OF THE INVENTION

The present invention relates generally to a freezable smoking pipe and more particularly to a freezable smoking pipe with integrated reflective particles for producing a cool, dry smoke that flows to the mouth, and providing an ornamental smoking experience.

BACKGROUND OF THE INVENTION

Various forms of smoking pipes are known in the art. Generally, such pipes are used to aid in smoking tobacco or tobacco-like substances, including medicinal herbs, and other organic material. Over time, numerous variations of pipes, hookahs, and the like have been evolved. The use of a cooling agent, such as water or another suitable substance in a liquid state, in connection with smoking pipe has been particularly popular because of the inherent benefits associated with cooling the smoke before being inhaled by the user.

A drawback of existing water pipes is that the smoke is not sufficiently cooled prior to being inhaled by the user. While the water cools the hot smoke to an extent, the cooling action may not be as thorough as many smokers desire.

Further, there exists a need in the art for an improved smoking device wherein the smoking device retains the benefits of conventional smoking pipes and further improves on its shortcomings, thus there is a need for a freezable smoking pipe that can be used to provide cool and dry smoke while providing an ornamental smoking experience to the user.

Numerous innovations have been provided in prior art that are adapted to a throwing apparatus and its method of operation. Even though these innovations may be suitable for the specific purposes to which they address, however, they would not be as suitable for the purposes of the present invention.

For example, U.S. Design Pat. No. D,254,510 to Shaak discloses an ornamental design for a pipe.

U.S. Design Pat. No. D,582,094 to Lee describes an ornamental design for a pipe.

U.S. Pat. No. 1,142,998 to Turner teaches a tobacco pipe and cigar or cigarette holder comprising a tubular mouthpiece connected with a tubular stem, a closed cooling shell extending into the tubular stem and water arranged within the closed shell. The cooling shell is preferably formed of thin sheet metal.

U.S. Pat. No. 2,263,464 to Lackow et al. describes a pipe bowl having a stem provided with a smoke passage for conveying the smoke from burning tobacco to the user's mouth, and a closed tubular coil slidably engaged about the outside of the stem for cooling the smoke passing through the stem.

U.S. Pat. No. 2,827,903 to Niederman teaches a self-cooling filter cigarette having a mouth portion provided with a heat radiating unit and a filtering unit, located outwardly of the heat radiating or smoke cooling unit, while the smoke cooling unit may be placed directly against the cylindrical plug of tobacco. A paper wrapper encloses both smoke cooling unit and the filter, so that the cigarette when viewed from the outside before being smoked has a conventional appearance.

U.S. Pat. No. 2,952,263 to Terenzi discloses a tobacco pipe having a tobacco burning bowl and a stem having a smoke passage therein extending therefrom, a flexible and resilient cooling unit surrounding the bowl and the adjacent portion of the stem and a coolant such as water for maintaining the bowl and the smoke in the stem passage adjacent said bowl cool when burning tobacco smoke passes therein.

U.S. Pat. No. 3,506,018 to Petrino describes a cigarette holder having a socket for receiving a cigarette at the inlet end, a mouthpiece at the discharge end, and a smoke cooling member such as liquid gas under pressure in between the two. The smoke treating member consists of a plurality of smoke conducting tubes that are mutually spaced and contained within a housing member that is placed in the inlet end of the mouthpiece.

U.S. Pat. No. 4,164,950 to Bechtold teaches a smoking appliance comprising a burning bowl, an upstanding cooling chamber, a flexible hose, and a removable container for supporting a solid-phase cooling medium within an intermediate portion of the cooling chamber. The smoke is exposed to a large surface area of the cooling medium to affect a thorough tempering and treating action.

U.S. Pat. No. 8,348,223 and U.S. Patent Application No. 20,110,005,533 to Evans disclose a flexible mold for a smoking device, wherein the molding medium is generally any substance that is viscous enough to be introduced into the mold and substantially fill the mold and is adapted to transform in the mold to a solid or semi-solid state sufficiently rigid to be used as a smoking device upon removal from the mold. The molding medium is preferably water; however, wine, fruit juice, or other liquid substances having similar thermal properties to water could be alternately used.

U.S. Pat. No. 9,185,936 to El-Deiry describes a smoking ice hose configured to fit on the mouthpiece of a water pipe to cool smoke immediately before inhalation of the smoke. A cooling agent such as an ice cube, an ice pack, dry ice or a combination thereof may be infused with an aromatic substance or a flavored substance to enhance the flavor and/or aroma of smoke which passes through hose.

U.S. Patent Application No. 20,120,180,803 to Beloni teaches a smoking apparatus comprising a modular smoke plenum that can be implemented in a hookah, pipe or other smoking device. The smoking apparatus further comprising a bowl assembly connected with the plenum and the modular plenum is configured for receiving smoke from the bowl, a base for holding water configured for receiving smoke from the plenum and comprising a standard interface for direct connection with the plenum, and a mouthpiece for inhaling smoke after passing through the plenum or base.

U.S. Patent Application No. 20,140,048,085 to Cox discloses an integral cooling and filtering device designed to be fitted on a smoking end of a cigarette or other smoking article. A cooling section and a filter section are positioned between a receptacle and a mouthpiece section of the device.

U.S. Patent Application No. 20,150,068,540 and 20,150,342,250 to Hoch et al. describe a flexible water pipe mold is configured to make an ice water pipe by being filled with water and then freezing the water. The ice water pipe includes a hollow ice body with a side opening, a base, a mouth piece, and a grommet. The water pipe chills the smoke for inhaling by the user.

U.S. Patent Application No. 20,160,044,960 to O'Connor teaches a therapeutic smoking and/or vaporizing device adapted for cooling down the smoke and/or vapor before being dispensed from apparatus comprising a bowl, a plenum chamber, an air pump, a dispensing means and at least one means. The cooling means comprising ice, solid carbon dioxide, anhydrous ammonia, refrigerants, or he like.

It is apparent now that numerous innovations for a cooling and filtering smoking apparatus have been developed in the prior art that are adequate for various purposes. Furthermore, even though these innovations may be suitable for the specific purposes to which they address, accordingly, they would not be suitable for the purposes of the present invention as heretofore described. Thus a freezable smoking pipe with integrated reflective particles for producing a long lasting cool, dry smoke that flows to the mouth, and providing an ornamental smoking experience is needed.

SUMMARY OF THE INVENTION

The present invention discloses a freezable smoking pipe with integrated reflective particles for producing a long lasting cool, dry smoke that flows to the mouth. The duration of the retained cool temperature of the cooling composition is at least partially dependent on the concentration of isopropyl; and whereby the reflective particles are visible through the walls to provide an ornamental smoking experience.

According to one aspect of the present invention a freezable smoking pipe with integrated reflective particles, comprises: a shaft, the shaft is defined by a shaft inner wall and a shaft outer wall disposed in a continuous, spaced-apart relationship, the shaft inner wall, or the shaft outer wall, or both being at least partially transparent; a channel formed along the length of the shaft inner wall; a bowl, the bowl defined by a bowl inner wall and a bowl outer wall disposed in a continuous, spaced-apart relationship, the bowl inner wall, or the bowl outer wall, or both being at least partially transparent; a mouthpiece in communication with the bowl through the channel; and a cooling composition including of at least one member selected from the group consisting of: isopropyl, water, and a plurality of reflective particles, the cooling composition configured to retain a cool temperature for a predetermined duration when cooled, the cooling composition disposed between the shaft inner wall and the shaft outer wall, the cooling composition further disposed between the bowl inner wall and the bowl outer wall, whereby the duration of the retained cool temperature of the cooling composition is at least partially dependent on the distance between the shaft inner wall and the shaft outer wall, and the distance between the bowl inner wall and the bowl outer wall, whereby the duration of the retained cool temperature of the cooling composition is at least partially dependent on the concentration of isopropyl alcohol.

In view of the foregoing, it is therefore an object of the present invention is to provide a smoking pipe that provides cool smoke in the channel of the shaft that flows from the bowl to the mouthpiece.

Another objective is to provide a cool and dry smoke.

Yet another objective is to provide a more flavorful smoke.

Yet another objective is to reduce exposure to cancer causing compounds.

Yet another objective is to adjust the distance between the walls of the shaft and bowl, so as to control the control the enclosed space between the walls and thereby controlling duration of cooling.

Yet another objective is to create an ornamental effect while smoking.

Yet another objective is to alter the color of the reflective particles.

Yet another objective is to provide a decorative color for the walls of the shaft and the bowl.

Other objectives and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

Figure 1:
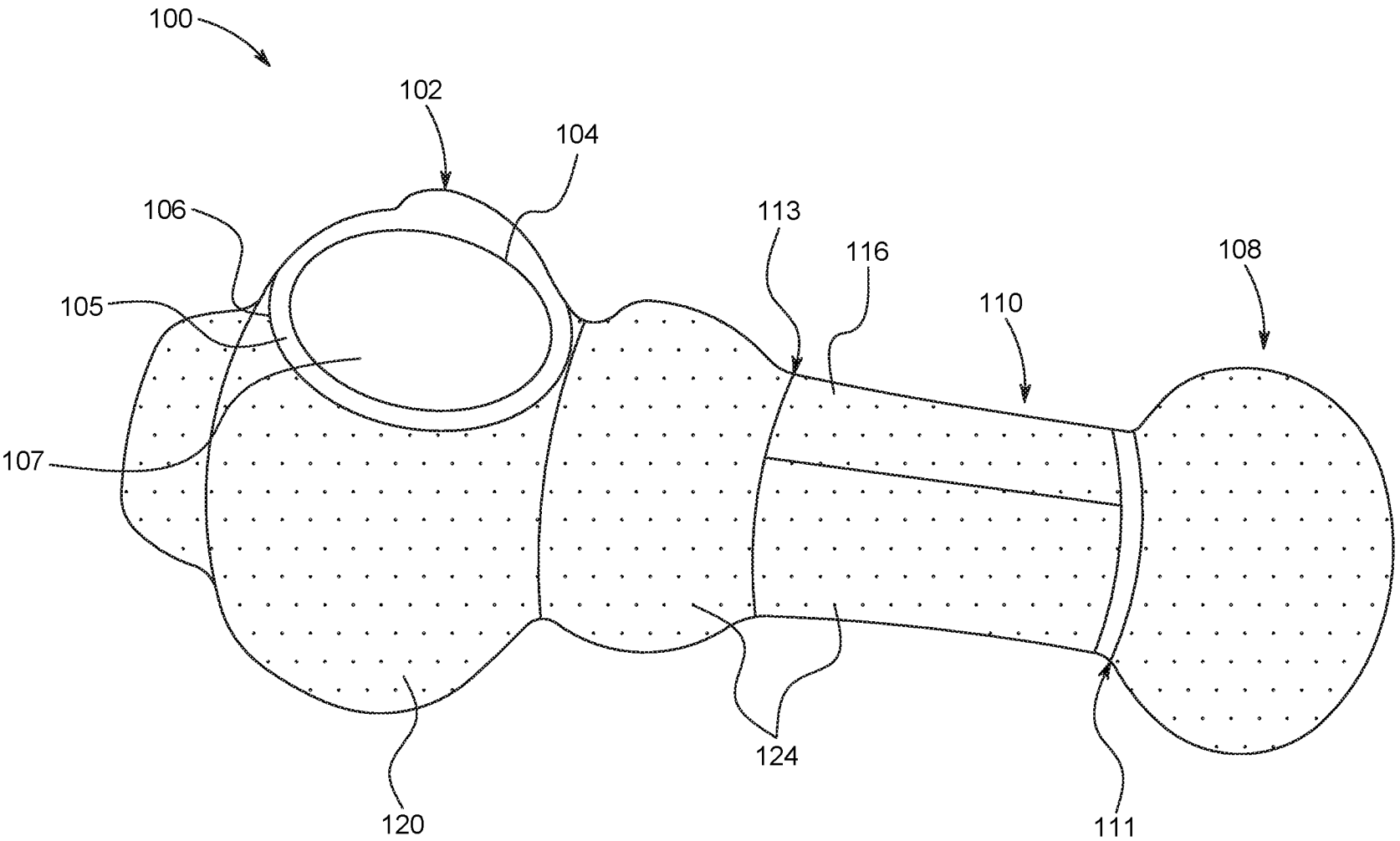
FIG. 1 illustrates a perspective view of an exemplary freezable smoking pipe, in accordance with an embodiment of the present invention.
Figure 2:
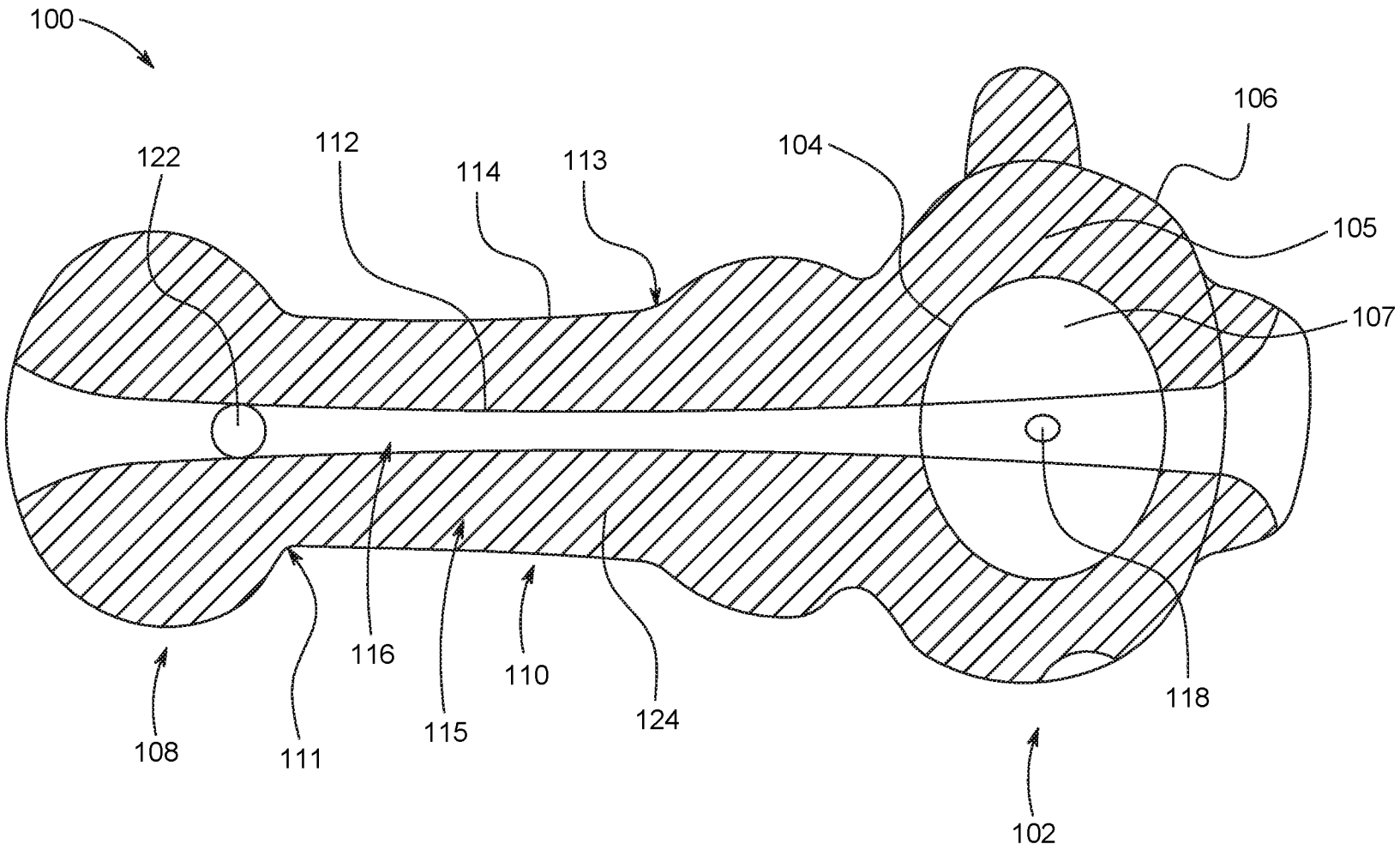
FIG. 2 illustrates a sectioned view of a freezable smoking pipe, showing the inner and outer walls of a bowl and a shaft, in accordance with an embodiment of the present invention.

A freezable smoking pipe with integrated reflective particles is referenced in FIGS. 1 and 2. The freezable smoking pipe 100 with integrated reflective particles, hereafter "pipe 100" is used for smoking an herb or tobacco, and cooling the subsequent smoke that flows to the mouth, so as to provide a more cooling, refreshing smoking experience. The pipe 100 also provides aesthetic features through transparent walls that enable viewing of a plurality of reflective particles that reflect light to produce an ornamental effect on the pipe 100.

Those skilled in the art will recognize that cooling smoke that passes from the bowl 102 of the pipe 100 to the mouth of the user optimizes the flavor and effect of the herb or tobacco. It is also known that cooler smoke produces a more flavorful herb or tobacco. Inhalation is also eased, as the harsh, heated smoke is cooled. Further, cooling the smoke that forms in a pipe reduces exposure to cancer causing compounds such as polycyclic aromatic hydrocarbons and benzopyrene.

Past efforts to cool smoke generated by a pipe have included simply placing the pipe in a freezer to allow the outer surface to cool. Soon after use, however, the pipe returned to the standard room temperature. Also, the freezing temperatures often cracked the pipe or created a slippery layer of moisture on the surface of the pipe. Other attempts to cool the smoke have utilized a water pipe, such as a hookah. This was, however, a large, cumbersome smoking apparatus that required a supply of water, hot charcoals, and was generally not very mobile.

Thus, the present adaptation of a pipe 100 enables the smoke to be cooled by a cooling composition 120 that is sealed within the walls of the pipe 100. The duration that the cooling composition 120 retains cool temperatures for cooling the smoke is partially dependent on the space between the inner and outer walls, and partially dependent on the concentration of an isopropyl found in the cooling composition 120. Furthermore, the cooling composition 120 has been enhanced to create an ornamental effect on the pipe 100 by configuring the walls to be transparent, and integrating a plurality of reflective particles 124 into the composition 120.

One aspect of a freezable smoking pipe 100 with integrated reflective particles 124, the pipe 100 comprising: a shaft 110, wherein the shaft 110 is defined by a proximal end 111 and a distal end 113, a shaft inner wall 112 and a shaft outer wall 114 disposed in a continuous, spaced-apart relationship from the proximal end 111 to the distal end 113 to form a closed space 115 between the shaft inner wall 112 and a shaft outer wall 114 and a hollow channel 116 at the center elongated along the length of the shaft 110, the shaft inner wall 112, or the shaft outer wall 114, or both being at least partially transparent; a bowl 102, wherein the bowl 102 is attached to the distal end 113 of the shaft 110 and the bowl 102 defined by a bowl inner wall 104 and a bowl outer wall 106 disposed in a continuous, spaced-apart relationship to form a closed space 105 between the bowl inner wall 104 and the bowl outer wall 106 and a chamber 107 at the center of the bowl 102 for placing and burning ingredients to generate smoke, thereby allowing the smoke to pass through a bowl opening 118 into the channel 116 of the shaft, further the bowl inner wall 104, or the bowl outer wall 106, or both being at least partially transparent; a mouthpiece 108 attached to the proximal end 11 of the shaft and, wherein the mouthpiece 108 includes a mouthpiece opening 122 that enables passage of the smoke from the bowl opening 118 into the mouth of the user through the channel 116; and a cooling composition 120 including isopropyl, water, and a plurality of floatable reflective particles 124, the cooling composition configured to retain a cool temperature for a predetermined duration when froze and produce a cool and dry smoke at the mouthpiece 108, the cooling composition 120 is disposed between the closed space 115 between the shaft inner wall 112 and the shaft outer wall 114 and the closed space 105 between the bowl inner wall 104 and the bowl outer wall 106, whereby the duration of the retained cool temperature of the cooling composition is at least partially dependent on the volume and the concentration of the isopropyl disposed between the closed spaces (115 and 105) of the shaft 110 and the bowl 102.

In another aspect, the channel 116 is about four millimeters in diameter.

In another aspect, the pipe 100 is configured to smoke an herb or tobacco.

In another aspect, the mouth piece 122 is integrated into the walls (112 and 114) at the proximal end 111 of the shaft 110, further the mouth piece 122 comprises a mouthpiece opening 122.

In another aspect, the bowl 102 comprises a bowl opening 118 to enable communication with the distal end 113 of the shaft 110.

In another aspect, the cooling composition 120 is sealed between the inner (112 and 104) and outer walls (114 and 106) of the shaft 110 and the bowl 102.

In another aspect, the isopropyl is about 70 percent concentration.

In another aspect, the pluralities of reflective particles 124 are generally flat.

In another aspect, the pluralities of reflective particles 124 are configured to reflect light to create a glittering visual effect.

In another aspect, the cooling composition 120 along with the reflective particles 124 flows freely between closed spaces (115 and 105) of the shaft 110 and the bowl 102.

In another aspect, the cooling composition 120 along with the reflective particles 124 flows within the closed space 115 of the shaft 110 and closed space 105 of the bowl 102, whereby the closed space 115 of the shaft 110 and the closed space 105 of the bowl 102 is separated by a divider (not shown).

In another aspect, the thickness of the inner wall 112 of the shaft 110 is thinner than the thickness of the outer wall 114 of the shaft 110.

In another aspect, the thickness of the inner wall 104 of the bowl 102 is thinner than the thickness of the outer wall 106 of the bowl 102.

In another aspect, the duration of the retained cool temperature of the cooling composition 120 is at least partially dependent on duration of freezing and temperature of the freezer used to cool the cooling composition 120.

In another aspect, the inner wall 112 and the outer wall 114 of the shaft 110 is made of materials including, polycarbonate or polyurethane or a rigid polymer or fiberglass or glass or combination thereof.

In another aspect, the inner wall 104 and the outer wall 106 of the bowl 102 is made of materials including, polycarbonate or polyurethane or a rigid polymer or fiberglass or glass or combination thereof.

In another aspect, a smoking pipe 100 with integrated freezable cooling composition 120, the pipe 100 comprising: a hollow shaft 110, wherein the hollow shaft 110 is defined by a shaft inner wall 112 and a shaft outer wall 114 disposed in a continuous, spaced-apart relationship and joined at both ends (111 and 113) of the shaft 110 to create a closed space 115 between the walls 112 and 114 and the hollow channel 116 is elongated along the length of the shaft 110, the shaft inner wall 112, or the shaft outer wall 114, or both being at least partially transparent; a bowl 102 connected to one end of the shaft 110, wherein the bowl 102 is defined by a bowl inner wall 104 and a bowl outer wall 106 disposed in a continuous, spaced-apart relationship and are circumferentially joined to create a closed space 105 between the walls of the bowl 102, the bowl inner wall 104, or the bowl outer wall 106, or both being at least partially transparent; and a cooling composition 120 including of at least one member selected from the group consisting of: isopropyl, water, and a plurality of free flowing reflective particles 124, the cooling composition 120 disposed between the shaft inner wall 112 and the shaft outer wall 114, the cooling composition 120 further disposed between the bowl inner wall 104 and the bowl outer wall 106 to cool the smoke carried from the bowl 102 into the mouth of the user through the channel 116 of the shaft 110, while free movement of reflective particles 124 creates an aesthetic glittering effect of the smoking pipe 100.

One objective of the present invention is to cool smoke in the channel 116 of the shaft 110 that flows from the bowl 102 to the mouthpiece 108.

Another objective is to provide a cool and dry smoke.

Yet another objective is to provide a more flavorful smoke.

Yet another objective is to reduce exposure to cancer causing compounds.

Yet another objective is to adjust the distance between the walls of the shaft 110 and bowl 102, so as to control the duration of cooling.

Yet another objective is to create an ornamental effect while smoking.

Yet another objective is to alter the color of the reflective particles 124.

Yet another objective is to provide a decorative color for the walls of the shaft 110 and the bowl 102.

As referenced in FIG. 1, the pipe 100 helps produce a cool and dry smoke that flows to the mouth, and creates an ornamental smoking experience. The pipe 100 is a smoking pipe used to smoke herbs and tobacco. The pipe 100 is transparent and filled with a freezable cooling composition 120, consisting of water, isopropyl and reflective particles 124. Upon freezing the pipe 100, the cooling composition 120 absorbs heat from the smoke flowing through the channel 116 to produce a cool, dry smoke at the mouthpiece 108. The duration that the cooling composition 120 retains cool temperatures for cooling the smoke is partially dependent on the space between the inner and outer walls 104, 112, 106, 114, and partially dependent on the concentration of an isopropyl found in the cooling composition 120. Furthermore, the cooling composition 120 has been enhanced to create an ornamental effect on the pipe 100 by configuring the walls 104, 112, 106, 114 to be at least partially transparent, and integrating a plurality of reflective particles 124 into the composition 120. The at least partially transparent walls enable viewing of a plurality of reflective particles 124 contained in the cooling composition 120. The reflective particles 124 move in the isopropyl and water to reflect light and produce a glittering effect on the pipe 100.

In some embodiments, the pipe 100 may include a shaft 110. The shaft 110 is the primary component for carrying smoke to the mouth of the user. The shaft 110 also serves as a handle for manipulating the pipe 100. The shaft 110 is defined by a shaft inner wall 112 and a shaft outer wall 114 disposed in a continuous, spaced-apart relationship and joined at both ends (111 and 113) of the shaft 110 to create a closed space 115 between the walls 112 and 114. The distance between the shaft inner wall 112 and the shaft outer wall 114 may be adjustable during manufacture of the pipe 100. The shaft inner wall 112, or the shaft outer wall 114, or both are at least partially transparent and may also have at least one color or color pattern for ornamental effect. Suitable materials for the shaft 110 walls may include, without limitation, polycarbonate, polyurethane, a rigid polymer, fiberglass, and glass.

In some embodiments, a channel 116 formed along the length of the shaft inner wall 112. The channel 116 is configured to carry the smoke from the bowl 102 to the mouthpiece 108 through the shaft 110. Those skilled in the art will recognize that when air passes quickly through a restricted passageway, such as the channel 116, turbulence moves the heavy particles, including the moisture, to the surface of the inner walls 104, 112, like separating cream from milk. Thus, by cooling the surface of the walls 104, 112, 106, 114, the heat from the smoke transfers to the cooler temperature of the walls 104, 112, 106, 114. In one embodiment, the channel 116 is about four millimeters in width or diameter and uniform in size. Though other sizes and dimensions may be used without departing from the scope and spirit of the invention.

Looking now at FIG. 2, the pipe 100 further includes a bowl 102. The bowl 102 receives burning ingredients like herb or tobacco for creating smoke in a chamber 107 at the center of the bowl 102. The bowl 102 may include a bowl opening 118 at the bottom portion of the chamber 107, wherein the bowl opening 118 enables passage of the smoke from the bowl through the channel 116 and into the mouth of the user. The bowl 102 is defined by a bowl inner wall 104 and a bowl outer wall 106 disposed in a continuous, spaced-apart relationship, which are circumferentially joined to create a closed space 105 between the walls of the bowl 102. Similar to the shaft walls 112, 114, the bowl inner wall 104, or the bowl outer wall 106, or both are at least partially transparent. In one embodiment, the shaft inner wall 112 and the bowl inner wall 104 form a continuous wall. The bowl inner wall 104, or the bowl outer wall 106, or both are at least partially transparent and have at least one color or color pattern for ornamental effect. Suitable materials for the bowl 102 walls may include, without limitation, polycarbonate, polyurethane, a rigid polymer, fiberglass, and glass.

In some embodiments, a mouthpiece 108 is in communication with the bowl 102 through the channel 116. The mouthpiece 108 may include a mouthpiece opening 122 that enables passage of the smoke from the channel 116 and into the mouth of the user. The mouthpiece 108 may be integrated into the walls 112, 114 of the shaft 110 or may be an interchangeable component separate from the shaft 110.

The capacity to retain cool temperatures along the shaft 110 of the pipe 100 is due to a cooling composition 120 that is sealed between the shaft inner wall 112 and the shaft outer wall 114, and the bowl inner wall 104 and the bowl outer wall 106. The cooling composition 120 may flow freely between the shaft 110 and the bowl 102, or may be separated by a divider (not shown). The cooling composition 120 cools the walls 104, 112, 106, 114, and especially the inner walls 104, 112 of the shaft 110 and the bowl 102. Thus, as smoke passes through the channel 116, heat transfers from the channel 116 to the cooler inner walls 104, 112 of the shaft 110 and the bowl 102. This results in a cool, dry smoke being received at the mouthpiece 108. It is significant to note that the wall thickness of the interior tube (channel 116) at least partially dictates the extent that the smoke is cooled while passing through the channel 116. The thinner that the thickness of the inner wall 112 is, the more effective the pipe is for cooling smoke passing through the channel 116. This is because a thinner wall has less insulative material than a thicker inner wall. And thus, less insulation allows the heat from the smoke to disperse through the thinner inner wall. In an exemplary embodiment, the thickness of the inner wall (104 and 112) of the bowl 102 and the shaft 110 is thinner than the thickness of the outer wall (106 and 114) of the bowl 102 and the shaft 110. Further the outer wall (106 and 114) of the bowl 102 and the shaft 110 may comprise an insulative transparent coating to prevent the pipe 100 to remain cool for a longer period of time.

The cooling composition 120 includes of at least one member selected from the group consisting of: isopropyl, water, and a plurality of reflective particles. Those skilled in the art will recognize that isopropyl, also called isopropanol or dimethyl carbinol, is a compound with the chemical formula $C_3H_8O$ or $C_3H_7OH$ or $CH_3CHOHCH_3$. Isopropyl is a colorless, flammable chemical compound with a strong odor. As a propyl group linked to a hydroxyl group, it is the simplest example of a secondary alcohol, where the alcohol carbon atom is attached to two other carbon atoms, sometimes shown as $(CH_3)_2CHOH$.

It is significant to note that most freezers are set at 0° Fahrenheit or slightly colder. Water freezes at about 32° Fahrenheit. A 70% concentration of isopropyl freezes at about −126° Fahrenheit. The exact freezing point for isopropyl is, however, dependent on the concentration. For example, a 50% concentration of isopropyl freezes more readily than the 70% concentration. Also, the water/isopropyl mixture of the cooling composition 120 is not truly a solution, but a mixture. Thus, it is substantially the water that freezes, while the isopropyl retains, at best, a slush composition 120. In any case, the capacity to retain the cold temperatures is greatly enhanced by the presence of isopropyl in the cooling composition 120.

The cooling composition 120 retains a cool temperature along the length of the shaft 110 and the bowl 102 for a predetermined duration when cooled. The duration of the retained cool temperature of the cooling composition 120 is at least partially dependent on the distance between the shaft inner wall 112 and the shaft outer wall 114, and the distance between the bowl inner wall 104 and the bowl outer wall 106. A wider space allows for more cooling composition 120 to fill the pipe 100; thus enabling longer cooling periods. Also, the percent concentration of the isopropyl is determinative of the duration of cooling the smoke in the pipe 100. Also, the temperature of the freezer used to cool the cooling composition 120 is determinative of the duration of cooling the smoke in the pipe 100.

Looking back at FIG. 1, the reflective particles 124 are visible through the walls 104, 112, 106, 114 to provide an ornamental smoking experience. The reflective particles may include small, flat slivers of reflective substrates that reflect light to produce a glittering effect. Those skilled in the art will recognize "glitter". Though in some embodiments, the reflective particles may be small, flat pieces of plastic having various colors. The reflective particles can be shaped and colored in any manner. The reflective particles are especially ornamental when moving freely in the water and isopropyl, because this allows light to reflect off multiple surfaces of the reflective particles.

In operation, an herb or tobacco is positioned inside the bowl 102. A high temperature or flame from a heat source is applied to a base portion of the bowl 102. This creates smoke, which flows from the bowl 102 towards the mouthpiece 108 through the channel 116. This flow of smoke is due to externally applied depressurization at the mouthpiece 108 (sucking). As the smoke flows through the length of the channel 116, the cooling composition 120 absorbs heat through the inner walls 104, 112 of the shaft 110 and the bowl 102. This serves to cool the smoke, creating a cool, dry smoke that is more flavorful and safer for consumption. Additionally, the reflective particles in the cooling composition 120 move freely as the pipe 100 is being manipulated while smoking. This free movement of reflective particles creates an aesthetic glittering effect, or other ornamental effect, depending on the type and quantity of reflective particles.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A smoking pipe with integrated freezable cooling composition, the pipe comprising:

a hollow shaft, wherein the hollow shaft is defined by a shaft inner wall and a shaft outer wall disposed in a continuous, spaced-apart relationship and joined at both ends of the shaft to create a closed space between the walls and a hollow channel at the center is elongated along the length of the shaft, the shaft inner wall, or the shaft outer wall, or both being at least partially transparent;

a bowl connected to one end of the shaft, wherein the bowl is defined by a bowl inner wall and a bowl outer wall disposed in a continuous, spaced-apart relationship and are circumferentially joined to create a closed space between the walls of the bowl, the bowl inner wall, or the bowl outer wall, or both being at least partially transparent; and a cooling composition including at least one member selected from the group including at least one member selected from the group consisting of:

a mixture of isopropyl alcohol, water, and a plurality of free flowing reflective particles, the cooling composition disposed sealed in the closed space between the shaft inner wall and the shaft outer wall, the cooling composition further disposed sealed in the closed space between the bowl inner wall and the bowl outer wall to cool the smoke carried from the bowl into the mouth of a user through the hollow channel at the center along the length of the shaft, while free movement of reflective particles creates a glittering effect of the smoking pipe;

wherein the isopropyl alcohol is 70 percent by mole of the mixture and the water is 30 percent by mole of the mixture;

wherein the hollow channel elongated throughout the length of the shaft is about four millimeters in diameter; and wherein the glittering effect is shown through the bowl outer wall of the bowl.

2. The pipe of claim 1, wherein the pipe further comprises a mouthpiece which is integrated into the walls of the shaft.

3. The pipe of claim 1, wherein the shaft and the bowl are made of materials including, polycarbonate or polyurethane or a rigid polymer or fiberglass or glass or combination thereof.

4. The pipe of claim 1, wherein the thickness of the inner wall of the bowl and the shaft is thinner than the thickness of the outer wall of the bowl and the shaft.

* * * * *